United States Patent [19]

Kennedy et al.

[11] 4,169,254

[45] Sep. 25, 1979

[54] THERMALLY ACTIVATED EMERGENCY ELECTRIC SWITCH

[75] Inventors: Garth P. Kennedy; Neal R. Kennedy; William A. Kennedy, Jr., all of Oklahoma City, Okla.

[73] Assignee: Corken International Corporation, Oklahoma City, Okla.

[21] Appl. No.: 864,262

[22] Filed: Dec. 27, 1977

[51] Int. Cl.[2] ..... H01H 37/76

[52] U.S. Cl. ..... 337/409; 200/61.08

[58] Field of Search ..... 169/42, 61, 62; 337/402, 403, 407, 408, 409, 411, 143, 148, 150, 154, 156, 157, 108; 200/61.08, 200, 300

[56] References Cited

U.S. PATENT DOCUMENTS

| | | | |
|---|---|---|---|
| 2,058,288 | 10/1936 | Bamonte | 337/409 |
| 2,085,386 | 6/1937 | Phillips et al. | 337/409 |
| 2,912,535 | 11/1959 | Sullivan | 337/404 |
| 3,915,236 | 10/1975 | Stichling | 200/61.08 |

*Primary Examiner*—Harold Broome

*Attorney, Agent, or Firm*—Clarence A. O'Brien; Harvey B. Jacobson

[57] ABSTRACT

The manually actuable electric switch has a fusible element which melts on subjection to a predetermined temperature to discontinue the flow of electric current through the switch. The structure is incapable of operation on melting of the fusible element without replacement of the element, thereby preventing accidental reactivation of the switch prior to termination of the unusual thermal conditions causative of the melting of the element. A manually operable plunger normally used to open and close the switch is mechanically connected to the stem of the switch through the fusible element. Melting of the element severs the mechanical connection between the plunger and the switch.

10 Claims, 5 Drawing Figures

Fig. 2
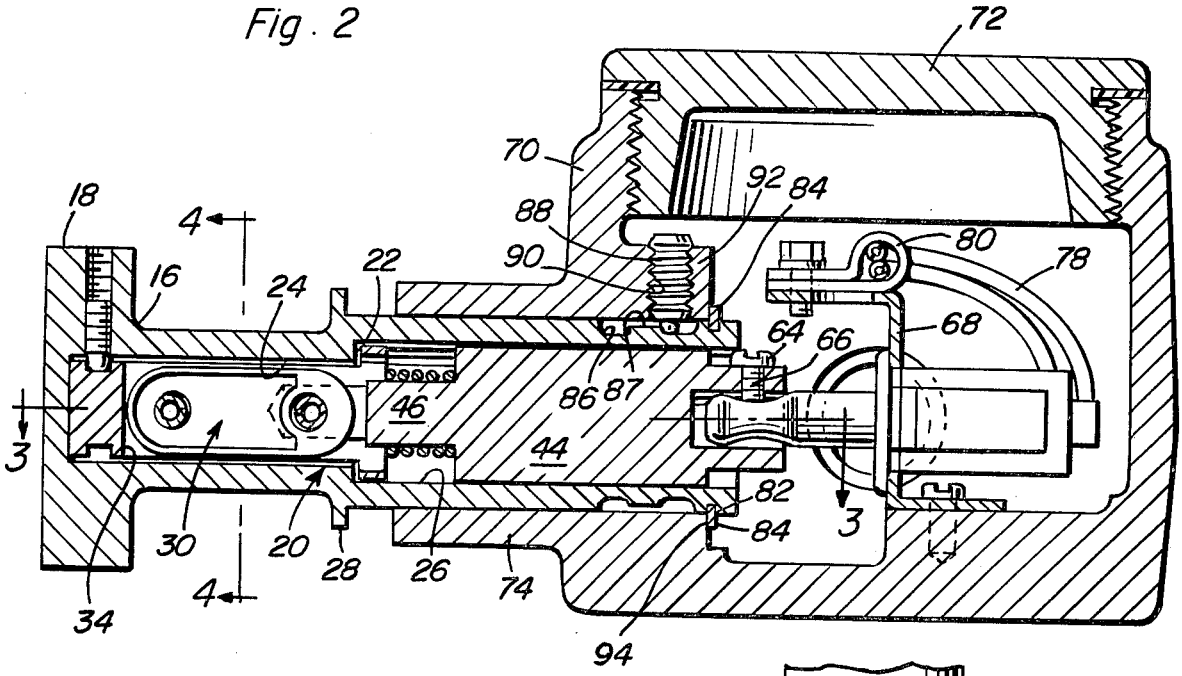
Fig. 3
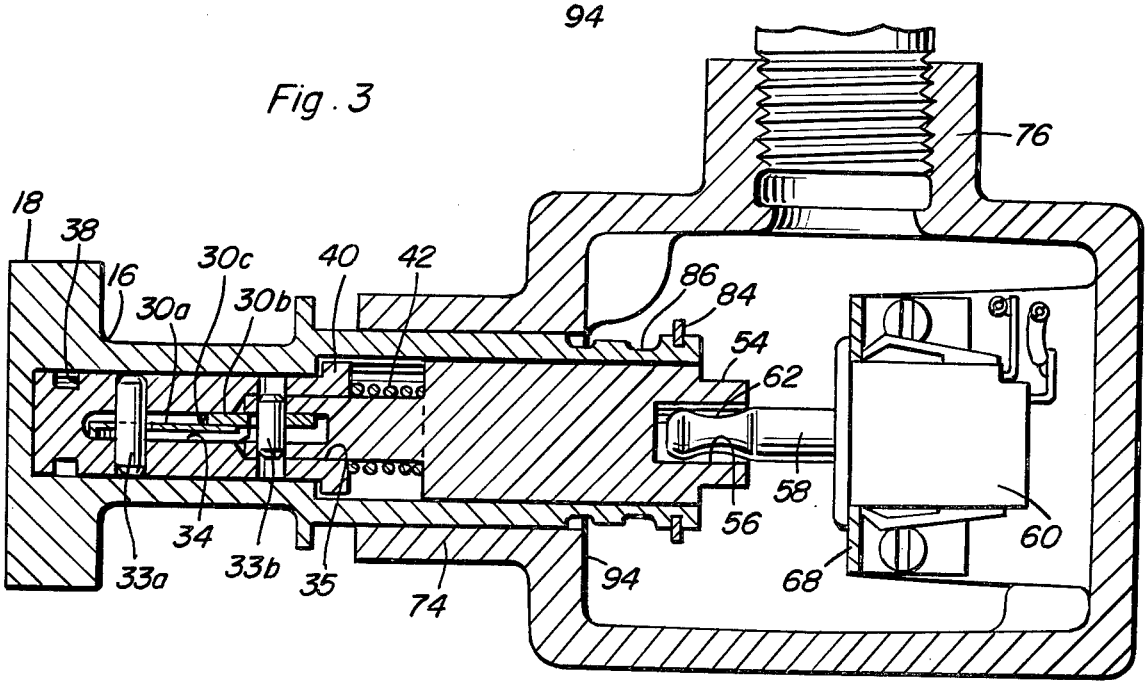
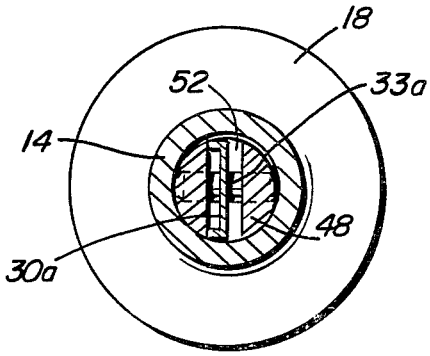
Fig. 4

THERMALLY ACTIVATED EMERGENCY ELECTRIC SWITCH

BACKGROUND OF THE INVENTION

1. Field of the Invention

The present invention generally relates to electrical switch mechanisms, and more particularly to apparatus for controlling the operation of an electric switch and which is responsive to excessively high temperature conditions to discontinue the flow of electrical current through the switch.

2. Description of the Prior Art

Electrical switches are often used in environments susceptible to the hazards of fire, the electrical current flowing through a switch being itself a potential source for ignition of flammable materials in the vicinity of the switch. Accordingly, the prior art includes a variety of switch devices which can be included in an electrical circuit between a source of electrical power and electrical equipment powered by said source, the switch devices being capable of interrupting the supply of electrical power to the electrical equipment in the event of excessively high temperature conditions caused by fire or overheating of the electrical equipment. Sullivan, in U.S. Pat. No. 2,912,535, provides a temperature responsive electrical switch which is also responsive to vibration and shock. Stichling, in U.S. Pat. No. 3,915,236, provides a safety device associated with an electrical appliance and operative on subjection to a sufficient level of heat to discontinue the flow of electricity through the circuit in which the switch is disposed. Phillips et al, in U.S. Pat. No. 2,085,386, discloses a fusible element which, on melting due to excessive thermal conditions, causes a switch to open, thereby discontinuing the flow of electrical current through the switch. While the prior art has provided switch mechanisms capable of discontinuing the flow of electrical current through a circuit in which the switch is disposed on exposure to unusually high heat levels, the prior art has not provided an electrical switch mechanism normally operated by a manually-operated plunger whereby the plunger is rendered ineffective on melting of a fusible link disposed within the mechanism. On melting of the fusible link of the present invention, the switch mechanism cannot be further operated without replacement of the link. The present invention, therefore, provides a manually-operable electrical switch mechanism capable of discontinuing the flow of electrical current within a circuit to alleviate hazardous conditions which would occur on continuation of electrical current flow, the switch mechanism of the invention not being capable of accidental reactivation prior to termination of the unusual thermal conditions causative of melting of the fusible element within the present switch mechanism.

SUMMARY OF THE INVENTION

The invention provides a manually-operable electrical switch mechanism having a plunger which is mechanically connected to the stem of an electrical switch, the plunger being displaceable to actuate the switch. The mechanical connection between the plunger and the stem of the switch includes a fusible link element located remotely from the switch and externally of a protective housing in which the switch is disposed, thereby allowing the fusible link element to be subjected to unusual thermal conditions at a time prior to the time that the electrical switch internal of the protective housing would be subjected to such conditions. In particular, the fusible link element of the present invention is disposed at an outer end of the plunger, the inner end of the plunger extending into the protective housing to engage the stem of an electrical switch, displacement of the plunger along its longitudinal axis acting to open and close the electrical switch, direct contact with the electrical switch within the protective housing not being necessary for actuation thereof. Since the fusible link element is disposed at the distal end of the plunger, the link element is not only allowed to melt more readily on subjection to high temperatures, such as are caused by fires, but also can be replaced easily after the unusual thermal conditions have abated. The ability to readily replace the fusible link element is advantageous due to the fact that the present switch structure is rendered incapable of further operation on melting of the fusible link element. Accidental reactivation of the electrical switch prior to alleviation of the unusual thermal conditions causative of melting of the fusible link element is thereby prevented.

Accordingly, it is an object of the present invention to provide switch actuation structure capable of allowing manual operation of an electrical switch, the present structure being responsive to excessively high thermal conditions to discontinue the flow of electrical current through the electric switch.

It is another object of the invention to provide manually-operable switch actuation structure having a fusible link element mechanically connecting a push-pull plunger to the stem of an electric switch disposed remotely from the distal end of the plunger, a fusible link element being included in the mechanical connection between the plunger and the stem of the electric switch.

It is a further object of the invention to provide a plunger-actuated switch structure wherein the distal end of the plunger is disposed remotely from an electrical switch actuated thereby, the switch being disposed within a protective housing and the plunger being mechanically connected to the stem of the switch through a fusible link element, the fusible link element being disposed at the distal end of the plunger external of the protective housing.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a sectional view taken along line 2—2 of FIG. 1;

FIG. 3 is a sectional view taken along line 3—3 of FIG. 2;

FIG. 4 is a sectional view taken along line 4—4 of FIG. 2; and,

DESCRIPTION OF THE PREFERRED EMBODIMENT

Figure 1:
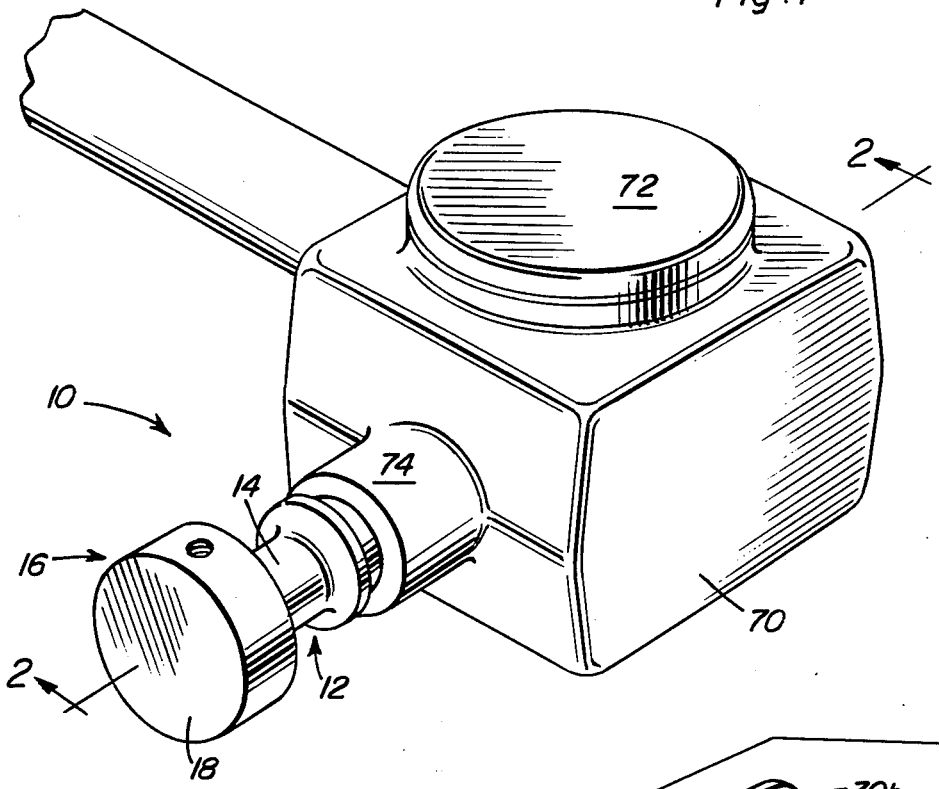
FIG. 1 is a perspective view of the present switch actuation structure.

Referring now to the drawings and particularly to FIG. 1, the switch actuation structure of the invention is seen generally at 10 to comprise a plunger 12 which extends into a protective housing 70 through an annular collar 74, the housing 70 having a push-pull electrical switch 60 mounted therein. As clearly seen in FIG. 1, the electric switch 60 is completely enclosed and protected by the protective housing 70. As further seen in FIGS. 2 and 3, the plunger 12 engages a stem portion 58 of the electric switch 60 at an inner end of the plunger, distal end portion 16 of the plunger 12 extending externally of the housing 70. A flange-like flared head 18 formed on the distal end portion 16 of the plunger 12 can therefore be grasped or manually contacted by a user of the structure 10 in order to remotely actuate the electric switch 60, inward displacement of the plunger 12 discontinuing the flow of electrical current through the switch 60 while outward displacement of said plunger 12 allows current flow through said switch 60.

As particularly seen in FIGS. 2 through 5, the plunger 12 comprises a tubular cylindrical body member 14 having a central elongated body cavity 20 disposed therein, a distal portion 24 of the cavity 20 communicating with an enlarged anterior portion 26 of said cavity 20. An annular shoulder 22 enlarges the anterior portion 26 of the cavity 20 at the plane of communication between said portions 24 and 26. An annular flange 28 is disposed on the outer surface of the cylindrical body member 14 for the purpose of limiting the depth to which the plunger 12 can be extended into the interior of the protective housing 70. The cylindrical body member 14 of the plunger 12 further has an annular recess 82 formed in the external surface of the anterior end of said member, a retainer ring 84 being received within the annular recess 82 to prevent full displacement of the plunger 12 from the housing 70. The retainer ring 84 abuts a shoulder 94 formed partially on an internal abutment 92 of the housing 70. The interal abutment 92 is further provided with a threaded apeture 90 which receives a spring-loaded snap detente 88 thereinto, a free end of the snap detente 88 being receivable within an annular channel 86 formed in the external surface of the cylindrical body member 14 outwardly of the annular channel 86. An annular ridge 87 is formed medially of the annular channel 86 and extends to a height intermediate between lowermost "floor" surfaces of the channel 86 and the external surface of the member 14. On displacement of the plunger 12 inwardly and outwardly of the protective housing 70, the snap detente 88 is biased by the ridge 87 to allow the free end of the detente 88 to "snap" into forward and rearward portions of said channel 86, thereby providing a positive "on-off feel" during operation of the plunger 12. The snap detente 88 further prevents movement of the plunger, and thus the stem portion 58 of the switch 60, due to vibration or other external causes of a similar nature. Accordingly, it is seen that the plunger 12 is substantially free to rotate about its longitudinal axis without diminution of function.

Figure 5:
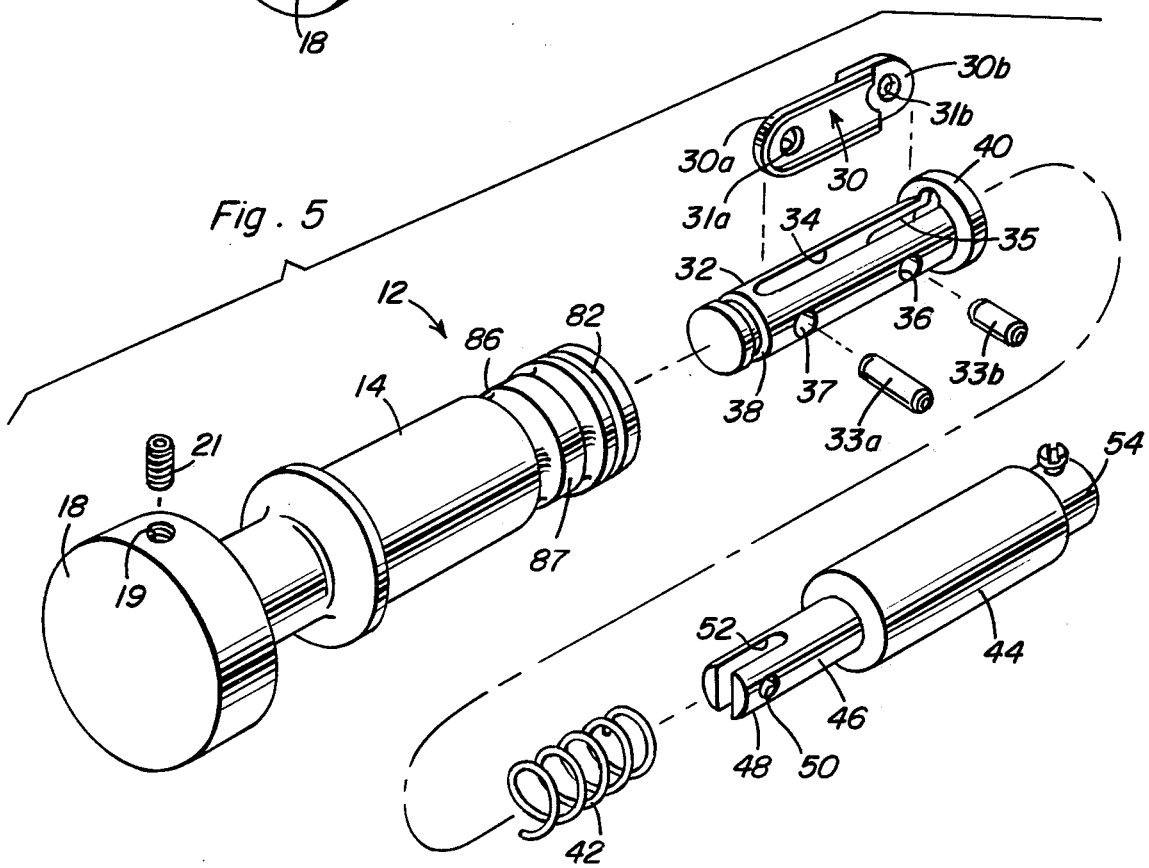
FIG. 5 is an assembly view in perspective of the structure of the manually-operable plunger of the invention.

As particularly seen in FIGS. 2, 3 and 5, a fusible link element 30 is received within a slot 34 in a link element holder 32, the link element holder 32 being comprised of a cylindrical body member sized to be received within the distal portion 24 of the cavity 20. The slot 34 is formed longitudinally of the link element holder 32, the holder 32 further having two pairs of aligned apertures 36 and 37 formed therein, the aligned apertures 36 and 37 respectively aligning and mating with spaced apertures 31*a* and 31*b* disposed in the fusible link element 30. Accordingly, a pin 33*a* inserted through the apertures 37 in the holder 32 is also received through the aperture 31*a* in the fusible link element 30. On insertion of the holder 32 into the distal portion 24 of the cavity 20 of the cylindrical body member 14, an annular recess 38 formed in the distal end portion of the holder 32 aligns with an aperture 19 formed in the head 18, a pin 21 being received into the recess 38 through said aperture 19 to lock the holder 32 in place within the cavity 20. The holder 32 is further provided with an annular flange 40 formed at the other end thereof, the flange 40 abutting the shoulder 22 formed in the member 14. The slot 34 communicates anteriorly of the holder 32 with a cylindrical recess 35 formed in said holder 32, the recess 35 receiving a link element connector 46 therewithin. The link element connector 46 comprises a distal end portion of a cylindrical inner body member 44, the inner body member 44 being received within the enlarged portion 26 of the cavity 20. The link element connector 46 is reduced in diameter relative to the inner body member 44 and mounts a spring 42 between the flange 40 on the holder 32 and the enlarged portion of said inner body member 44, the spring 42 acting to force the holder 32 and the inner body member 44 apart. The link element connector 46 has a slot 52 formed in the distal end thereof, the slot 52 lying between spaced legs 48 of said connector 46. Aligned apertures 50 are formed one each in each of the spaced legs 48, the apertures 50 aligning with the rearmost apertures 36 in the link element holder 32 and the rearmost aperture 31*b* in the fusible link element 30. Therefore, a relatively shorter pin 33*b* extends through the apertures 31*b* and 50 to maintain the holder 32 in spaced relation to the inner body member 44 against the force exerted therebetween by the spring 42. The apertures 36 in the holder 32 allow assembly of the pin 33*b* into the apertures 31*b* and 50. Accordingly, the holder 32 and the inner body member 44 are carried in a fixed position relative to the cylindrical body member 14 and internally thereof, said holder 32 and inner body member 44 being movable with the cylindrical body member 14 and connecting said body member 14 mechanically to the stem portion 58 of the electric switch 60 disposed internally of the housing 70. The inner body member 44 is further seen to have a collar 54 formed on the anterior end thereof, a cylindrical cavity 56 being mounted by the collar 54 and receiving the stem portion 58 of the switch 60 thereinto. An aperture 66 formed in the collar 54 receives a detente 64, such as a setscrew, or the like, the detente 64 engaging the stem portion 58 at a portion 62 thereof which is reduced in diameter relative to the remaining portions of said stem portion 58. The stem portion 58 of the switch 60 is thereby mechanically connected to the plunger 12 in a manner to allow angular displacement of the plunger 12 relative to the housing 70 and to the stem portion 58 of the switch 60.

The electric switch 60 is seen to be mounted, such as by screws, or the like, on a switch bracket 68 within the interior of the protective housing 70. Electrical leads 78 enter the housing 70 through an annular collar 76 and are held therewithin by a clamp 80. The electrical leads 78 connect to the electric switch 60 in a well-known fashion. Access to the protective housing 70 is attained by removal of a cap 72 which is held over an opening in said housing, such as by a well-known thread mounting.

The fusible link element 30 can particularly be seen in FIGS. 3 and 5 to comprise offset distal and anterior portions 30*a* and 30*b*, the portions 30*a* and 30*b* having one of the apertures 31*a* and 31*b* respectively formed therein. While the entire fusible link element 30 can be formed of a material which will melt on subjection to a predetermined temperature, it is preferred to form the element 30 with a layer 30*c* disposed between the portions 30*a* and 30*b*, the layer 30*c* being formed of a eutectic alloy such as is known in the art. Such an alloy exhibits a rapid transition from a solid to a liquid phase on attainment of a predetermined temperature. Accordingly, when the element 30 is subjected for a sufficient period of time to a temperature adequate to heat the layer 30*c* to a predetermined temperature, the layer 30*c* melts and thus causes serverance of the physical connection between the portions 30*a* and 30*b*. On serverance of this connection, the spring 42 strongly biases the inner body member 44 rearwardly to displace the stem portion 58 of the electrical switch 60 toward the switch 60, thereby discontinuing the flow of electrical current through the switch 60. Manual displacement of the body member 14 after melting of the layer 30*c* does not displace the stem portion 50 of the electric switch 60 due to the fact that no mechanical connection then exists between the manually-operable portion of the plunger 12 and the switch 60. The fusible link element 30 must then be replaced in order for the switch 60 to be again actuated from externally of the protective housing 70.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a thermally responsive switch actuation apparatus having a switch operable on displacement of a stem portion of the switch, an improved actuation mechanism, comprising a plunger member mounted for displacement relative to the stem portion of the switch, the plunger member comprising:

an outer body member having a distal end portion, an anterior end portion, and an internal cavity formed therein;

a fusible link element disposed within the cavity;

means for mounting a distal end portion of the link element to the distal end portion of the outer body member;

an inner body member having a distal end portion and an anterior end portion, at least portions of the inner body member being received within the cavity in the outer body member, the anterior end portion of the inner body member engaging the stem portion of the switch;

means for mounting an anterior end portion of the link element to the distal end portion of the inner body member; and, spring means for biasing the inner body member toward the anterior end portion of the outer body member, the link element being mechanically connected to the outer and inner body members to prevent relative displacement therebetween against the force exerted by the spring means, the spring means acting to displace the inner body member to deactivate the switch on melting of the fusible link element due to thermal conditions encountered in the environment of the apparatus.

2. In the apparatus of claim 1 wherein the improvement further comprises:

a protective housing enclosing the switch and having an aperture through which at least a portion of the plunger member is received, the fusible link element being disposed externally of the housing within the outer body member of the plunger member.

3. In the apparatus of claim 1 wherein the outer body member has an aperture formed in the distal end portion thereof and the first-mentioned means comprises:

a link holder member having a longitudinal slot formed therein and a pair of aligned apertures formed in the holder member at the distal end portion thereof and communicating with the interior of the slot, the fusible link element being disposed within the slot and having an aperture formed in the distal end portion thereof, the aperture in the link element aligning with opposed apertures in the holder member, the holder member being received within the cavity in the outer body member at the distal end portion thereof, the holder member further having a recess formed in the surface of the distal end portion;

a first pin member received within the aligned apertures in the distal end portions of the holder member and the link element to mount said link element to said holder member; and, a second pin member received within the aperture in the distal end of the outer body member, the second pin member extending into the recess formed in the surface of the distal end portion of the holder member to maintain the holder member within the cavity at the distal end portion of the outer body member.

4. In the apparatus of claim 3 wherein the holder member has a cavity formed longitudinally in the anterior end portion thereof, the cavity communicating with the slot, and wherein the anterior end portion of the link element has an aperture formed therein; the second-mentioned means comprising:

a link connector member formed on the distal end portion of the inner body member, a distal end portion of the link connector member being received within the cavity formed in the holder member, the connector member having a slot formed in the distal end portion thereof and aligned apertures formed therein on either side of the slot, the anterior end of the link element being received within the slot formed in the connector member, the aperture formed in the anterior end of the link element aligning with the apertures in the connector member; and, a third pin member respectively received within the aligned apertures in the distal end portion of the connector member and the anterior end portion of the link element to mount said link element to said coonnector member, the spring means being carried on the link connector member and biasing against the anterior end portion of the holder member and the distal end portion of the inner body member.

5. In the apparatus of claim 4 wherein the improvement further comprises a protective housing enclosing the switch and having an aperture through which at least a portion of the plunger member is received, the fusible link element being disposed externally of the housing within the outer body member, the outer body member having a depression formed in the external surface at the anterior end portion thereof, a detente member being mounted in the housing and having a free end portion extending into the depression, the depression having a ridge disposed centrally therein, the free end of the detente member snapping over the ridge on movement of the plunger member inwardly and outwardly of the housing.

6. In the apparatus of claim 5 wherein the anterior end portion of the outer body member has an annular channel formed therein, a retaining ring disposed within the channel and biasing against portions of the housing adjacent the aperture in the housing on outward movement of the plunger member.

7. In the apparatus of claim 4 wherein the anterior end portion of the inner body member has a cavity formed longitudinally therein, the cavity receiving at least a portion of the stem portion of the switch thereinto, that portion of the stem portion received within the cavity being reduced in diameter medially of its length, the inner body member having an aperture formed therein, the aperture communicating with the cavity in the inner body member, and a pin member receivable within the aperture in the inner body member and extending into the cavity therein to engage the stem portion at the portion thereof which is reduced in diameter, thereby to engage the inner body member with the stem portion of the switch.

8. In the apparatus of claim 2 wherein the improvement further comprises a bracket member mounted interiorly of the housing to mount the switch and a clamp member mounted on the bracket member to mount connections to the switch.

9. In the apparatus of claim 1 wherein the fusible link element is formed of separable distal and anterior portions, the improvement further comprising:

a layer of a eutectic alloy disposed between the distal and anterior portions of the link element and holding the portions together, the layer being meltable on subjection to predetermined thermal conditions to allow severance between the portions and separation thereof.

10. In a thermally responsive switch actuation apparatus having a switch operable on displacement of a stem portion of the switch, an improved actuation mechanism, comprising a plunger member engageable with the stem portion of the switch and mounted for displacement with the stem portion of the switch for manual operation of the switch, the plunger member comprising:

a first body member having a distal end portion and an anterior end portion;

a fusible link element;

means mounting a distal end portion of the link element to the distal end portion of the first body member;

a second body member having a distal end portion and an anterior end portion, at least portions of the second body member being coextensive with the first body member, the anterior end portion of the second body member engaging the stem portion of the switch;

means for mounting an anterior end portion of the link element to the distal end portion of the second body member; and, spring means for biasing the second body member toward the anterior end portion of the first body member, the link element being mechanically connected to the first and second body members to prevent relative displacement therebetween against the force exerted by the spring means and during manual operation of the plunger to displace the second body member to operate the switch on melting of the fusible link element due to thermal conditions encountered in the environment of the apparatus and melting of the fusible link element preventing manual displacement of the stem portion of the switch by displacement of the plunger.

* * * * *